US011242119B2

(12) United States Patent
Munsell

(10) Patent No.: US 11,242,119 B2
(45) Date of Patent: Feb. 8, 2022

(54) TRANSFORMING FLOATING DOCK SYSTEM

(71) Applicant: Michael Lee Munsell, Gainesville, FL (US)

(72) Inventor: Michael Lee Munsell, Gainesville, FL (US)

( * ) Notice: Subject to any disclaimer, the term of this patent is extended or adjusted under 35 U.S.C. 154(b) by 0 days.

(21) Appl. No.: 16/865,376

(22) Filed: May 3, 2020

(65) Prior Publication Data

US 2020/0391832 A1 Dec. 17, 2020

Related U.S. Application Data

(60) Provisional application No. 62/849,828, filed on May 17, 2019.

(51) Int. Cl.

| | |
|---|---|
| ***B63B 34/50*** | (2020.01) |
| ***B63B 34/10*** | (2020.01) |
| ***B63B 29/00*** | (2006.01) |

(52) U.S. Cl.

CPC ..... *B63B 34/50* (2020.02); *B63B 29/00* (2013.01); *B63B 34/10* (2020.02)

(58) Field of Classification Search

CPC ..... B63B 29/00; B63B 34/10; B63B 34/50

See application file for complete search history.

(56) References Cited

U.S. PATENT DOCUMENTS

| | | | | |
|---|---|---|---|---|
| 4,482,268 | A * | 11/1984 | Stevenson | B63C 3/06 114/44 |
| 6,901,877 | B1 * | 6/2005 | Winnett | B63B 35/00 114/268 |
| 2007/0292209 | A1 * | 12/2007 | Bishop | B63C 3/04 405/2 |
| 2020/0391832 | A1 * | 12/2020 | Munsell | B63B 34/50 |

* cited by examiner

*Primary Examiner* — S. Joseph Morano
*Assistant Examiner* — Jovon E Hayes
(74) *Attorney, Agent, or Firm* — Lohrman IP Law LLC; C. Richard Lohrman

(57) ABSTRACT

The invention presented is a transformable floating dock system comprising a stationary floating dock section with a pair of movable floating dock sections operatively attached to each end of the stationary dock. The transformable floating dock system can be moved into different configurations by rotating the movable sections around each other and around each end of the stationary dock to form different configurations of the dock system. The configurations can be transformed without entering the water or moving the stationary dock system.

8 Claims, 15 Drawing Sheets

TRANSFORMING FLOATING DOCK SYSTEM

CROSS REFERENCE TO RELATED APPLICATIONS

This patent application claims the benefit under 35 U.S.C. § 119(e) of U.S. Provisional Application No. 62/849,828, filed May 17, 2019, which application is incorporated herein by reference in its entirety.

STATEMENT REGARDING FEDERALLY SPONSORED RESEARCH OR DEVELOPMENT

N/A

THE NAMES OF THE PARTIES TO A JOINT RESEARCH AGREEMENT

N/A

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

N/A

STATEMENT REGARDING PRIOR DISCLOSURES BY THE INVENTOR OR JOINT INVENTOR

N/A

FIELD OF THE INVENTION

The field of the invention relates generally to waterway docking systems, more particularly to floating docking systems and still more particularly to transformable floating docking systems.

BACKGROUND OF THE INVENTION

Docks, wharves, piers, etc. (collectively "docks" or 'docking systems") are important both commercially in providing facilities to load and unload vessels, provide space for commercial vessels such as fishing vessels, etc. and recreationally as a means of access to rivers, lakes and other waters for boats for boating, fishing and similar activities.

One significant problem with docking systems is they are generally permanent structures that are difficult to modify. Even with a small single dock structure, to transform or modify the dock requires wading into the water to free the dock from its pilings and move it on land to perform the modifications. In addition, it may be necessary to wade back into the water to move, add or replace pilings before the modified dock is placed back into the water. This modification effort increases exponentially if additional docks or dock sections are added or moved.

Thus, there is a problem in the field in that there is no available docking system that supplies structures and method of transforming a docking system easily to accommodate desired changes such as increasing access for boats, adapting to new land structures near the dock or changes in the beach or land at the water's edge.

SUMMARY OF THE INVENTION

The invention broadly comprises a multi-sectional transforming floating dock system comprising: a stationary dock section having a first end having a first stationary round radius and a second end having a second stationary round radius; a first pair of floating dock sections wherein a first one of the first pair of floating dock sections includes a first round radius and a second one of the first pair of floating dock sections includes a second round radius that is functionally attached to the first round radius; a second pair of floating dock sections wherein a first one of the second pair of floating dock sections includes a first round radius and a second one of the second pair of floating dock sections includes a second round radius that matches with the first round radius; and, a turning tool. The first round radius of the stationary dock system is functionally attached to the first round radius of the first pair of floating dock sections and the second round radius of the stationary dock system is functionally attached to the first round radius of the second pair of floating dock sections. Each of the first and second pair of floating sections include a rotating system. Each of the rotating systems include cam rollers, track tubing, and pivot points linked by evenly distanced pivot swing arms and pivot can roller braces.

In an alternate embodiment, the system may include motors to move each dock system mechanically.

One object of the invention is to provide a floating dock system adaptable to changing conditions and needs at the system location.

A second object of the invention is to present a floating dock system that can be transformed without detaching and moving various dock sections.

A third object of the invention is to supply a floating dock system that can be transformed by a person(s) without entering the water.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF EMBODIMENTS OF THE INVENTION

At the outset, it should be appreciated that like drawing numbers on different drawing views identify identical structural elements of the invention. It also should be appreciated that figure proportions and angles are not always to scale in order to clearly portray the attributes of the present invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. It should be appreciated that the term "proximate" is synonymous with terms such as "nearby", "close", "adjacent", "neighboring", "immediate", "adjoining", etc., and such terms may be used interchangeably as appearing in the specification and claims. Although any methods, devices or materials similar or equivalent to those described herein can be used in the practice or testing of the invention, the preferred methods, devices, and materials are now described.

FIGS. 1-4 depict top schematic views of possible configurations/dimensions of the dock system platform sections of the present invention of transforming dock system 100 ("system 100"). Stationary floating dock 102 remains stationary except for floating on pilings 108 held to dock 102 by piling brackets 108*a*. In each of the system 100 configurations shown in FIGS. 1-4, stationary dock 102 remains stationary anchored in place by pilings 108.

Figure 1:
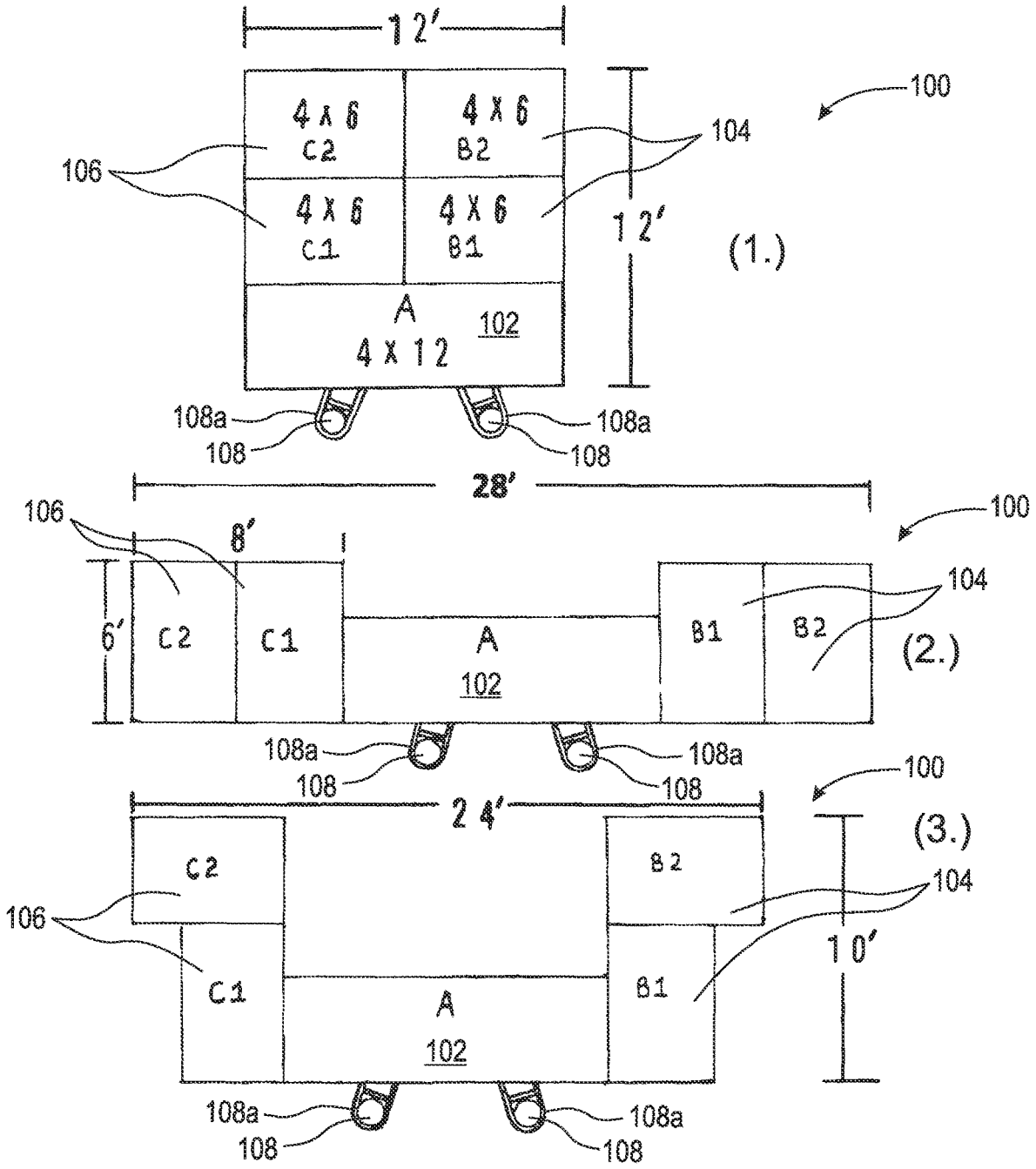
FIGS. 1-4. depict top schematic views of possible configurations/dimensions of the dock system platform sections of the present invention.
Figure 2:
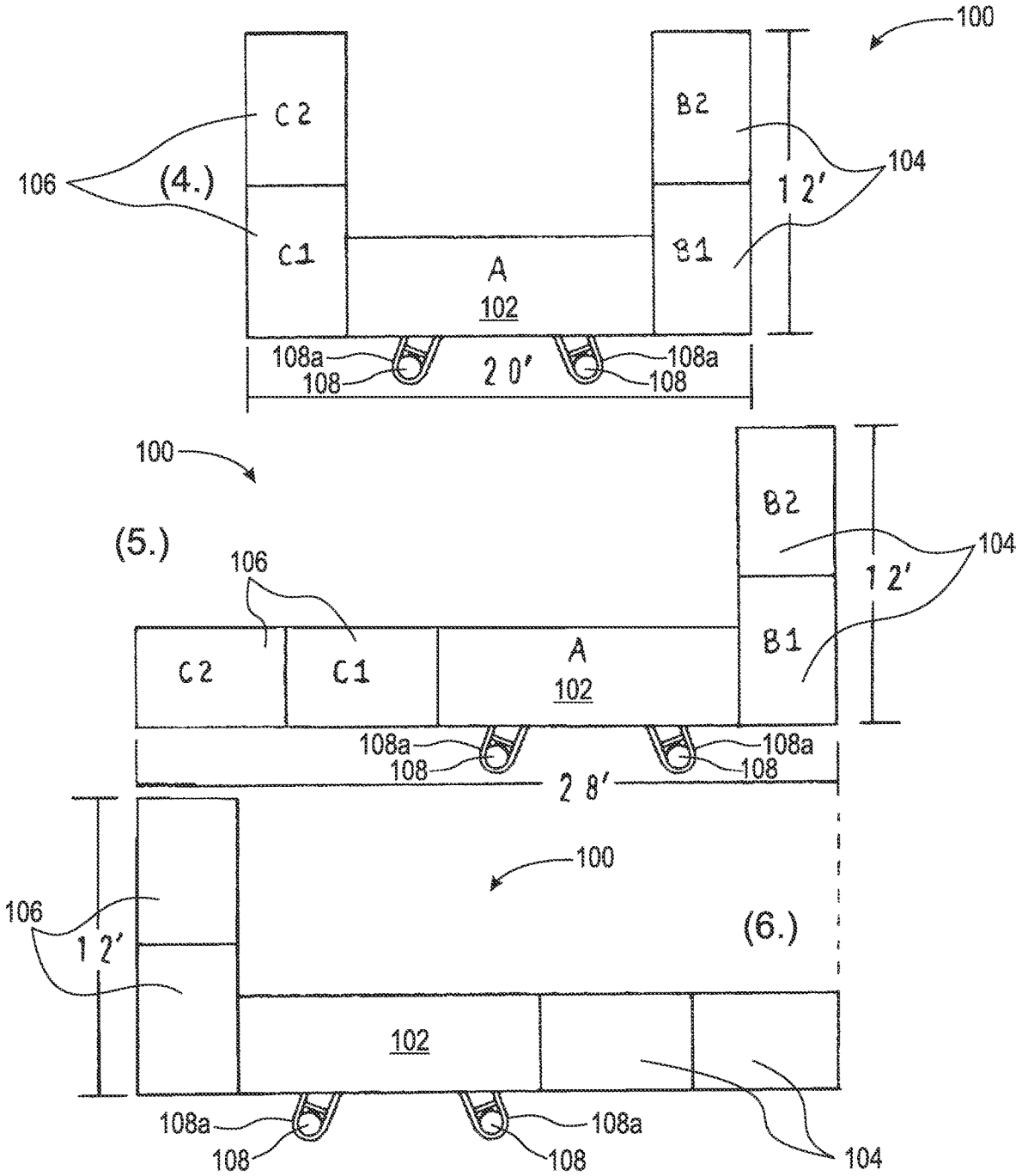
Figure 3:
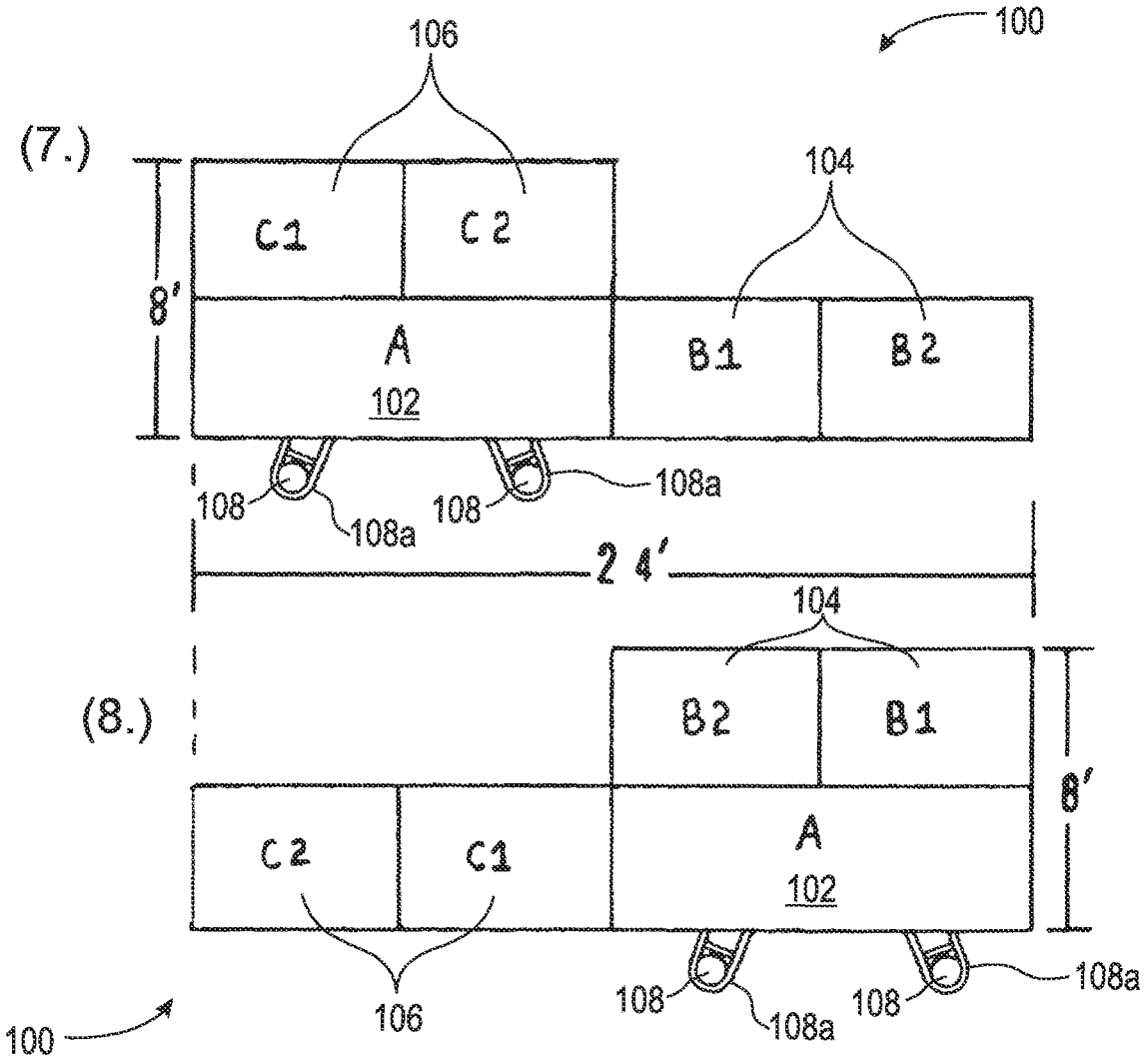
Figure 4:
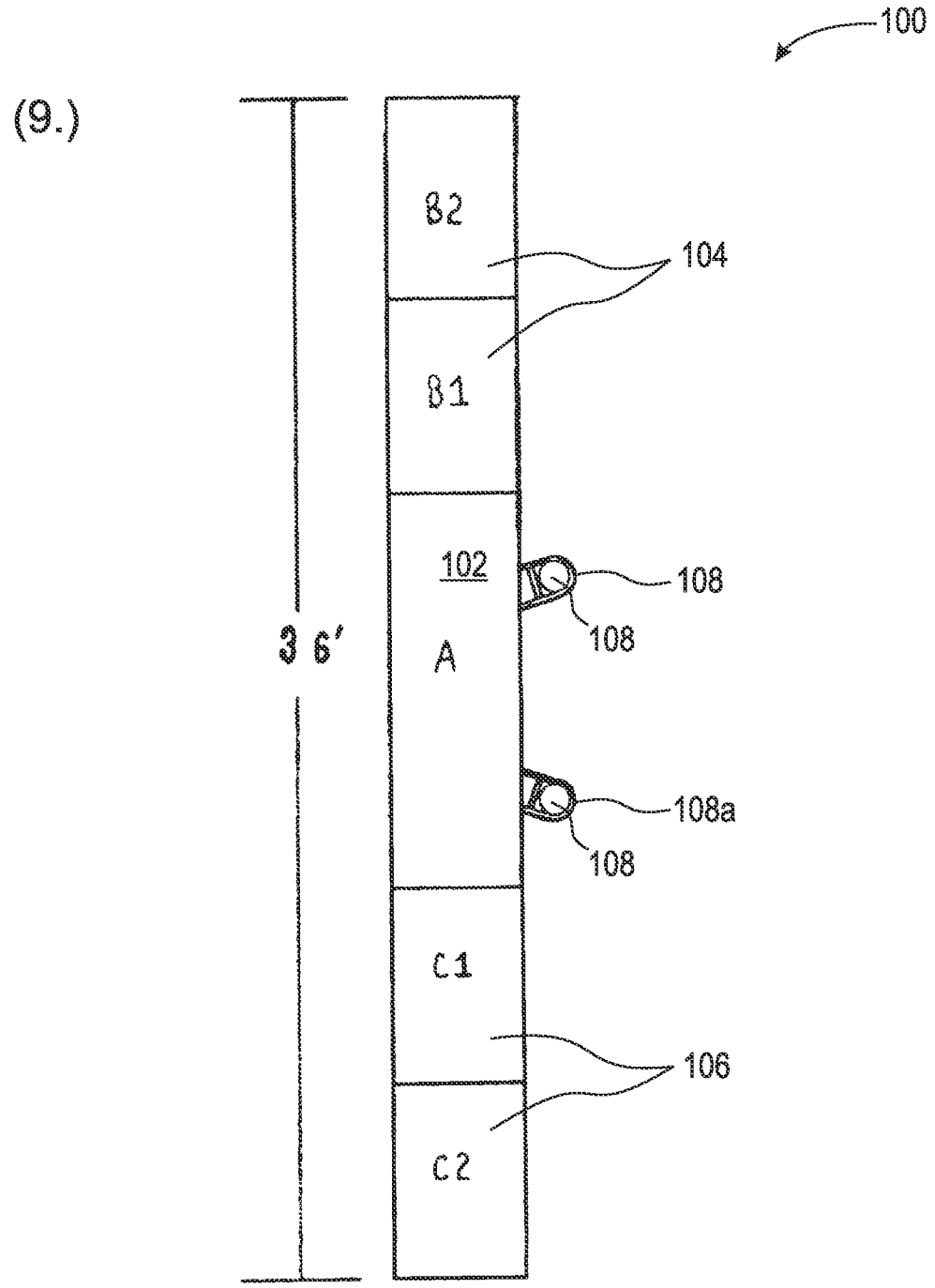
Figure 5:
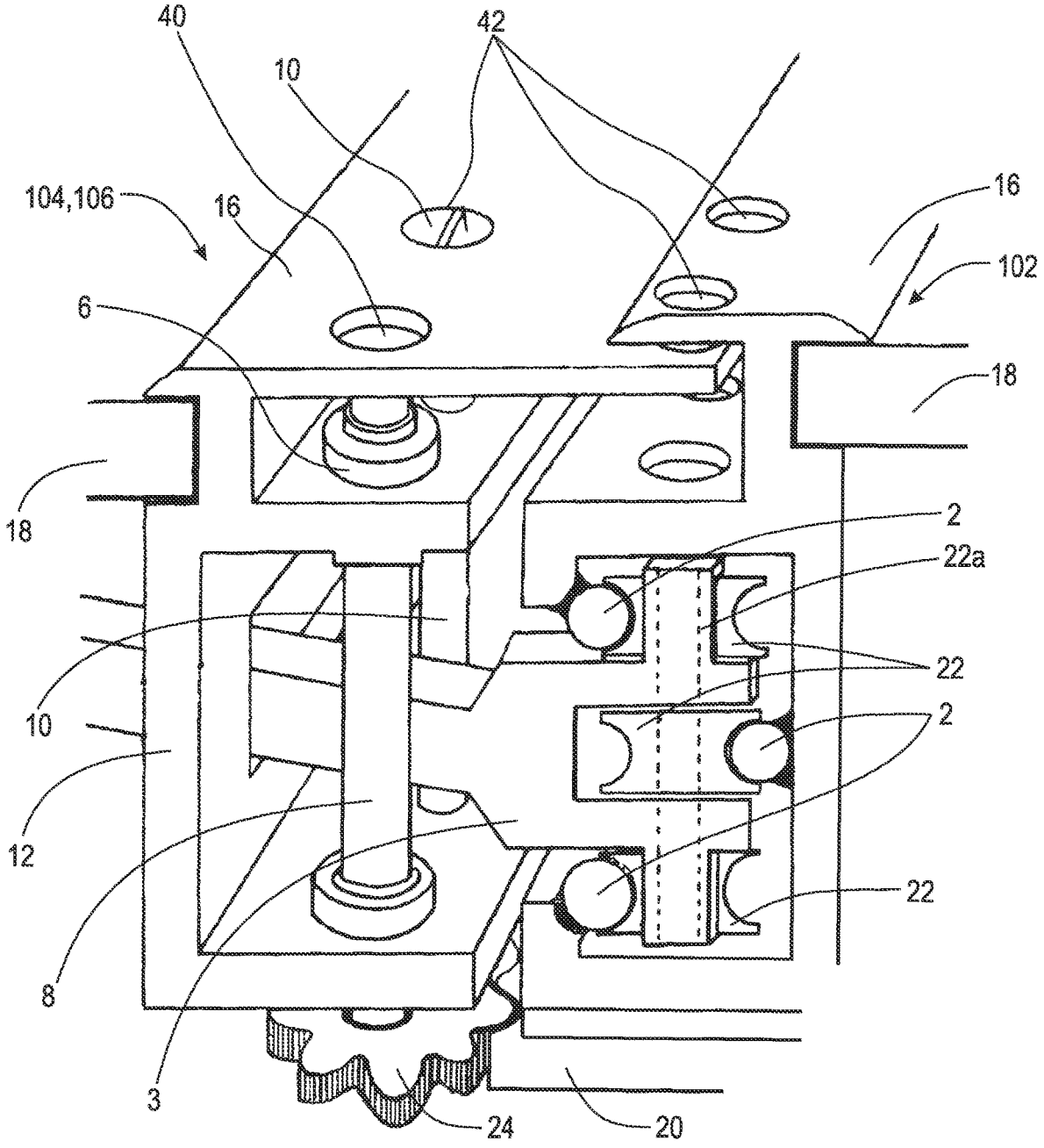
FIG. 5 shows a cut out side-view of the stationary dock section overlapping the frame of a floating dock section seen from FIGS. 1-4.

FIG. 5 shows a cut out side-view of either of the dock frames 12 of stationary dock section 102 and one of floating docks 104 or 106 from FIGS. 1-4. It denotes the locations of the Tubular Track System 2, Cam Rollers 22, Cam Roller axle 22*a*, Pivot Swing Arm 3, Pivot Pin 8 Locking Pin 10, Sealed Bearing 6, C-channel Frame 12, Bullet hole 40, Top T-cap 16, Gear 24, Decking Plank 18, and Interlocking Gear Teeth 20.

Figure 6:
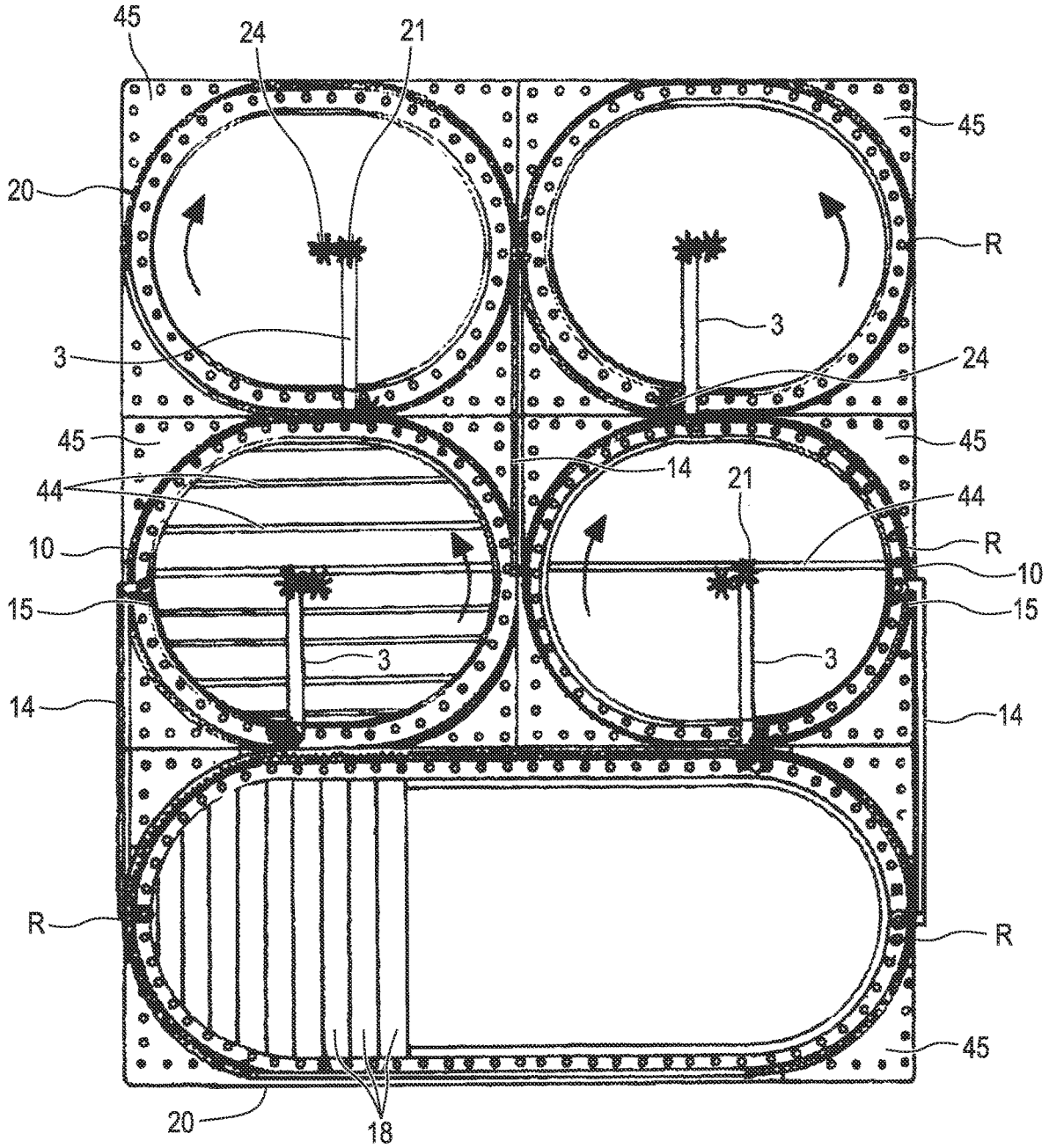
FIG. 6 is a top-view breakdown of the dock sections.

FIG. 6 is a top-view breakdown of the dock sections with the breakdown depicting top view which show center gear 21 interconnected with gear 24 followed by the view showing upper supports 44 and finally depicting deck planking 18. Seen are C-channel radii frame build with arrows to indicate rotation direction, Deck Boards 18, Upper Support Brace 44, Pivot Swing Arm 3, Pivot Cam Roller Brace 14, Cam Roller Stop 15, Interlocking Gear Teeth 20, and Corner Caps 45.

Figure 7:
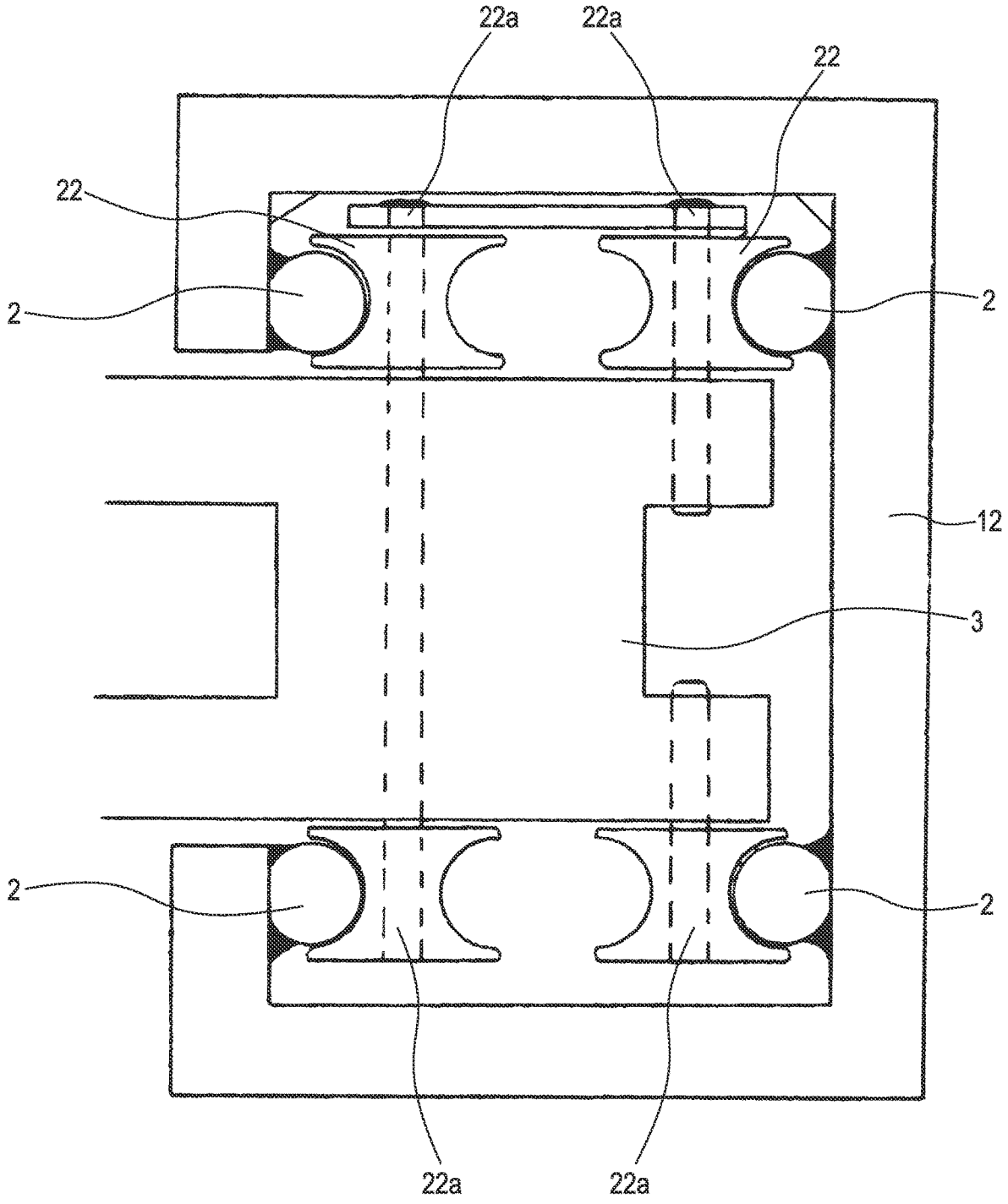
FIG. 7 is a cut away side-view of an alternative embodiment of the Cam Roller design seen in FIG. 5.

FIG. 7 is a cut away side-view of an alternative embodiment of the Cam Roller design seen in FIG. 5 with four Cam Rollers 22 and four Tubular Track System 2, C-channel frame 12, Pins 10, Pivot Swing Arm 3 as opposed to the three Cam Roller 22 and three Tubular Track Systems 2 that have been illustrated thus far in FIGS. 5 and 6.

Figure 8:
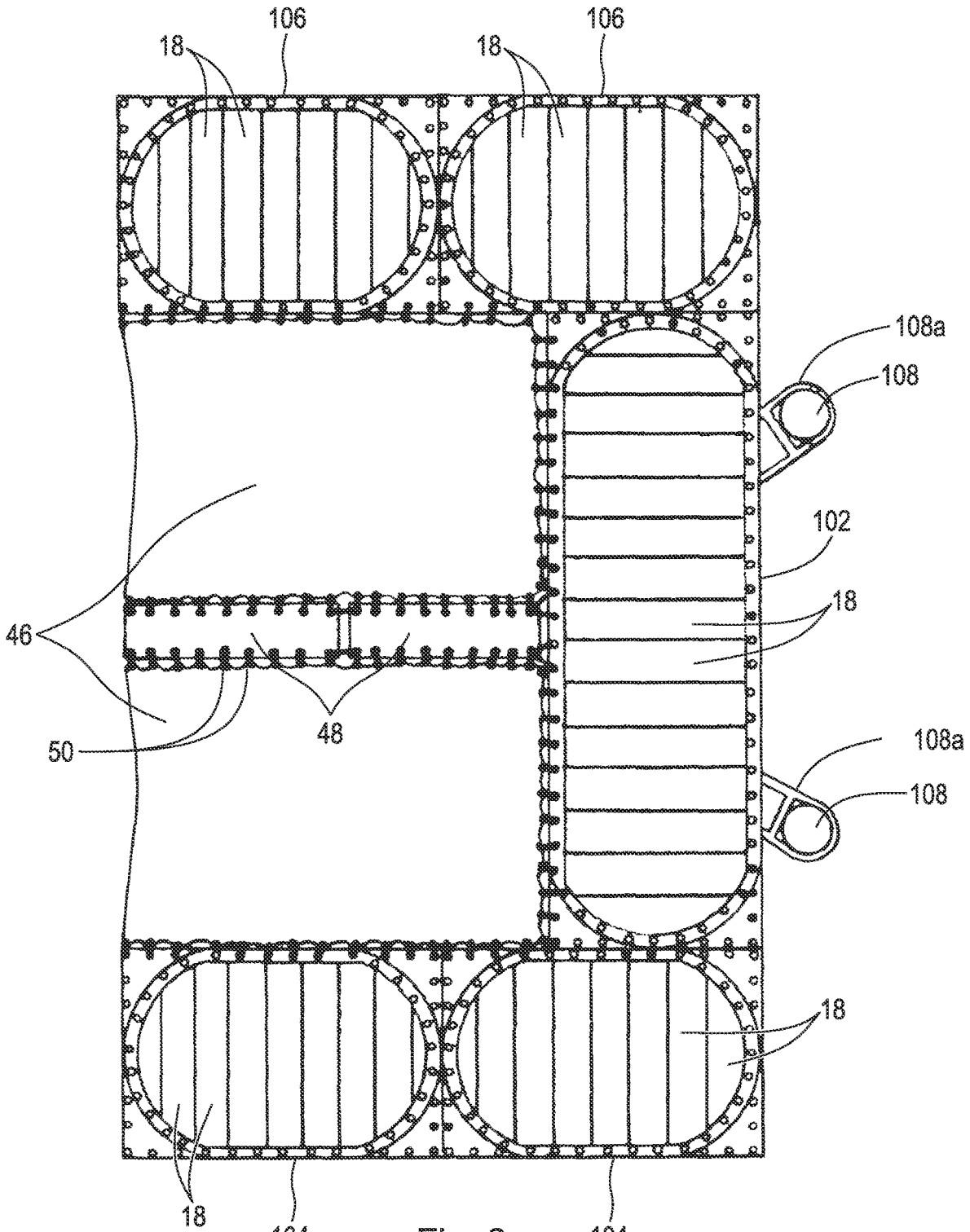
FIG. 8 is a top-view of a further embodiment of the dock system.

FIG. 8 is a top-view of a further embodiment of the dock system with an Attached Mesh Lounger 46, Center Floats 48, Lounger Clasps 50, piling 108, and piling bracket 108*a*.

Figure 9:
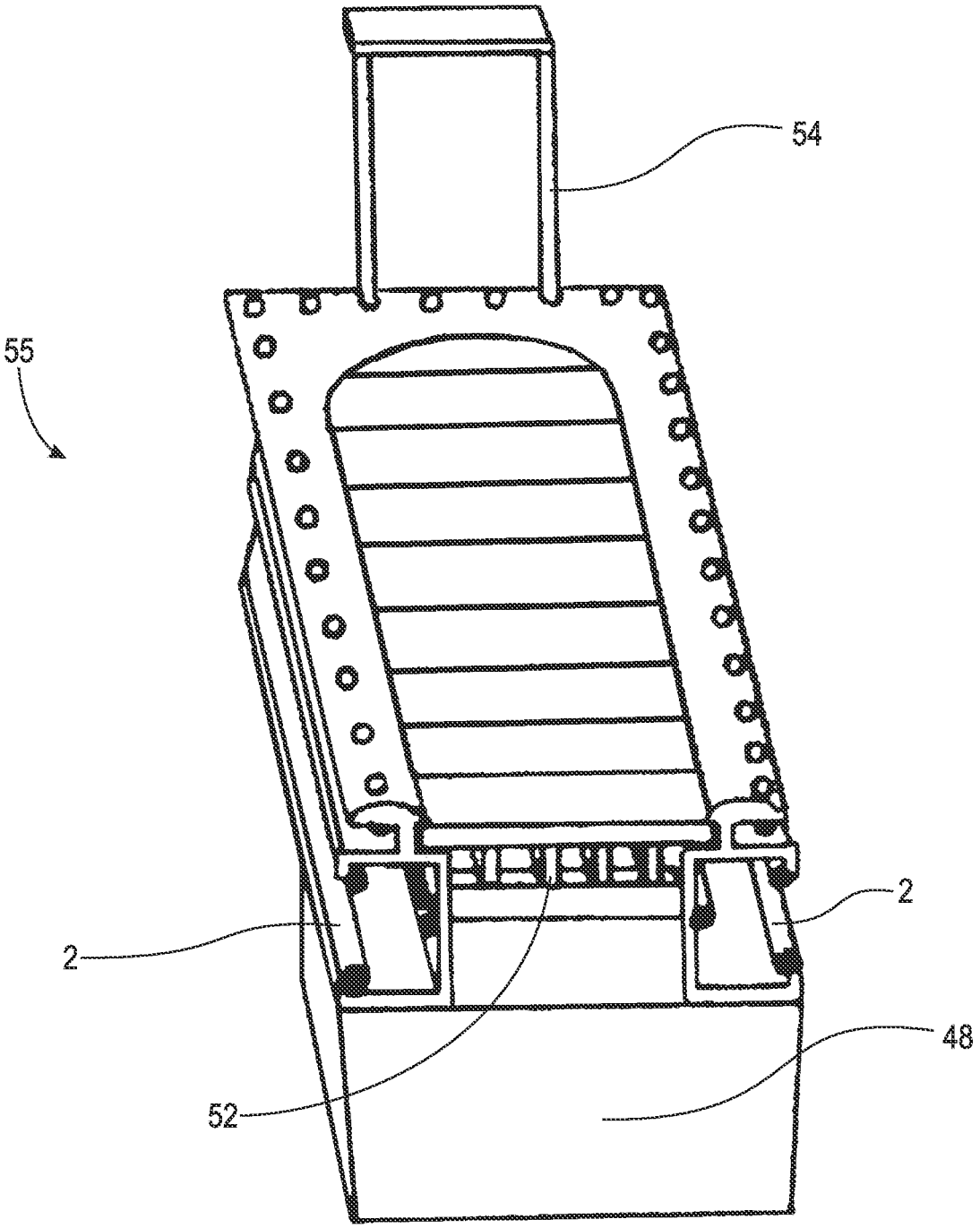
FIG. 9 is a top perspective view illustrating a Dock Float accessory system.

FIG. 9 is a top perspective view illustrating a Dock Float accessory system 55, Upper Support Brace 52, Tubular Track System 2, and Railing Accessory 54.

Figure 10:
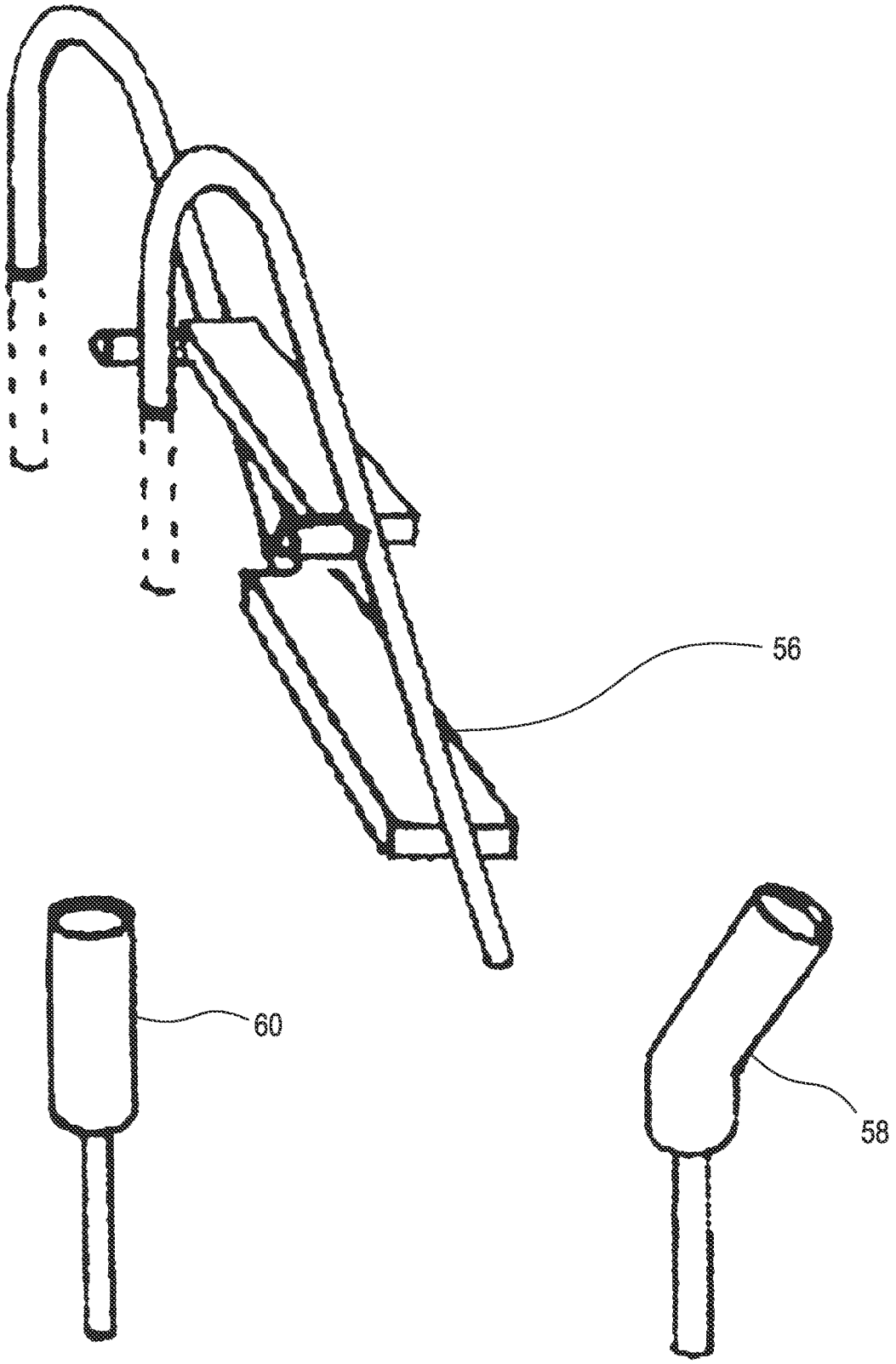
FIG. 10 depicts accessories that may be used with the present invention.
Figure 11:
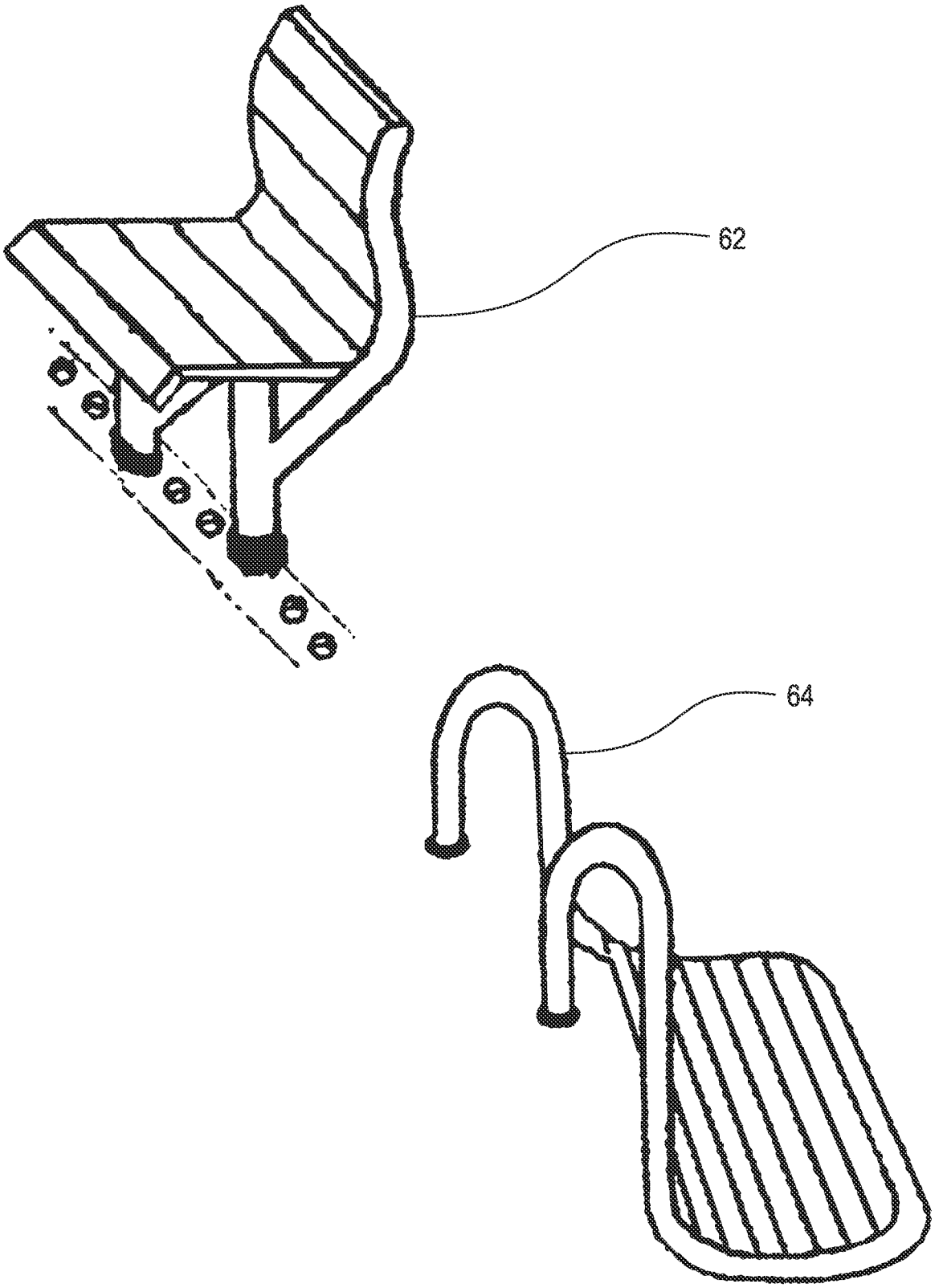
FIG. 11 shows additional accessories that may be used with the present invention.
Figure 12:
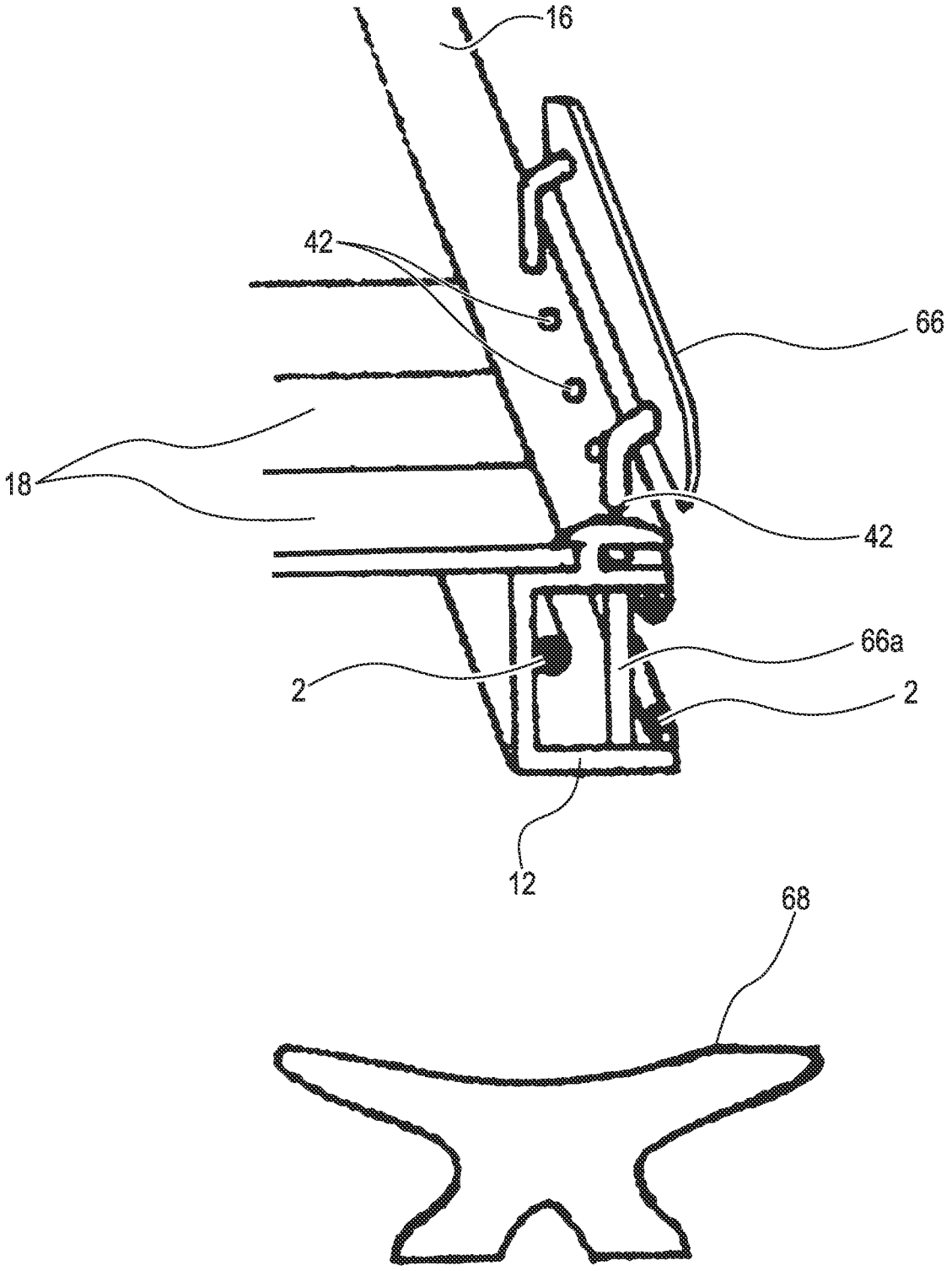
FIG. 12. shows still more additional accessories that may be used with the present invention.

FIG. 10 depicts accessories that may be used with the present invention: Ladder 56, Angled Rod Holder 58, and Straight Rod Holder 60. FIG. 11 shows additional accessories: Bench 62 (a.) and Kayak Platform 64, while FIG. 12 shows still more additional accessories: Boat Bumper Rail 66 with insertion pins 66*a* and Tie-off Cleat 68.

Figure 13:
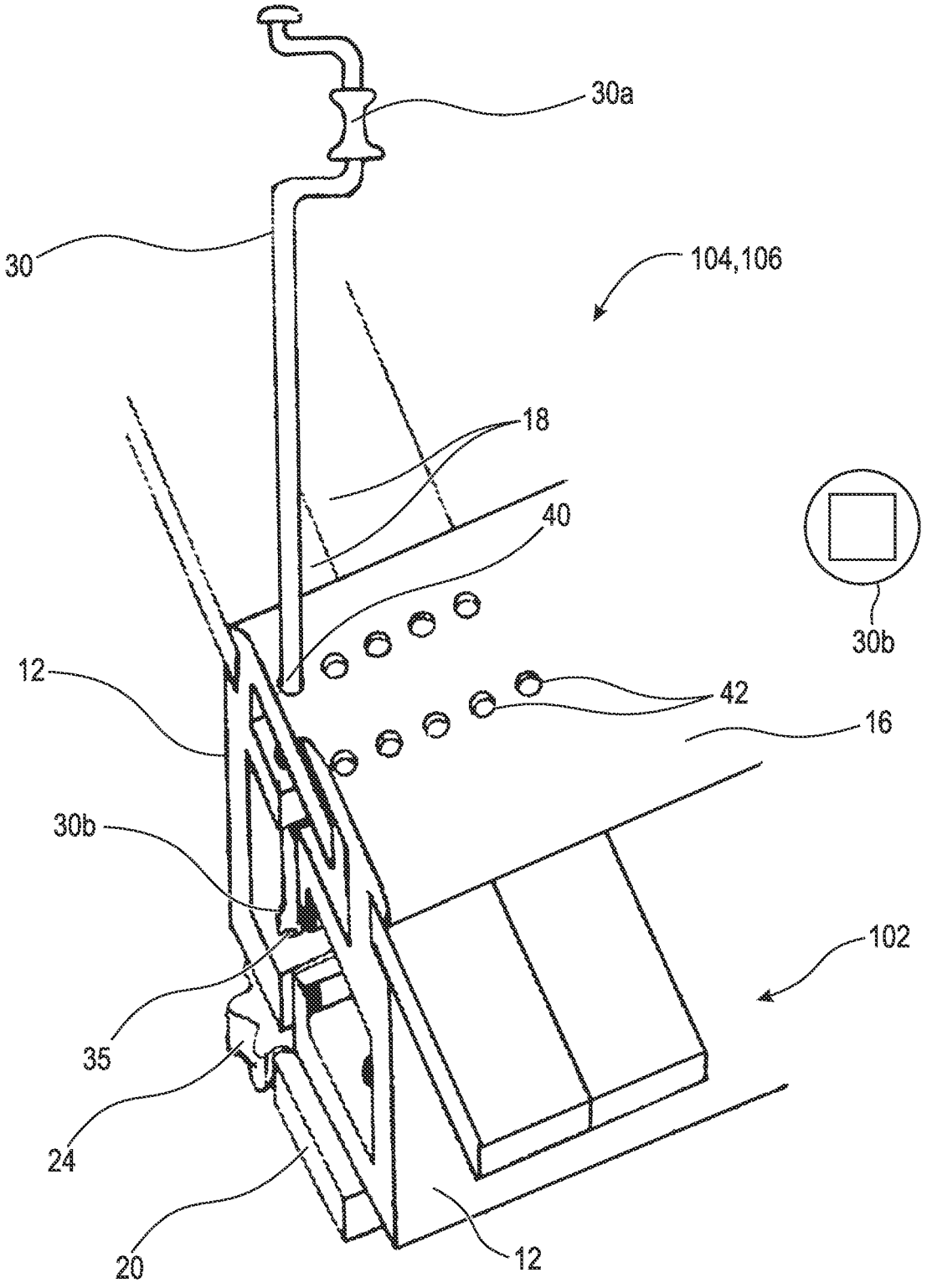
FIG. 13 is a top perspective view of the Top Hold Handle used to maneuver the dock sections.
Figure 14:
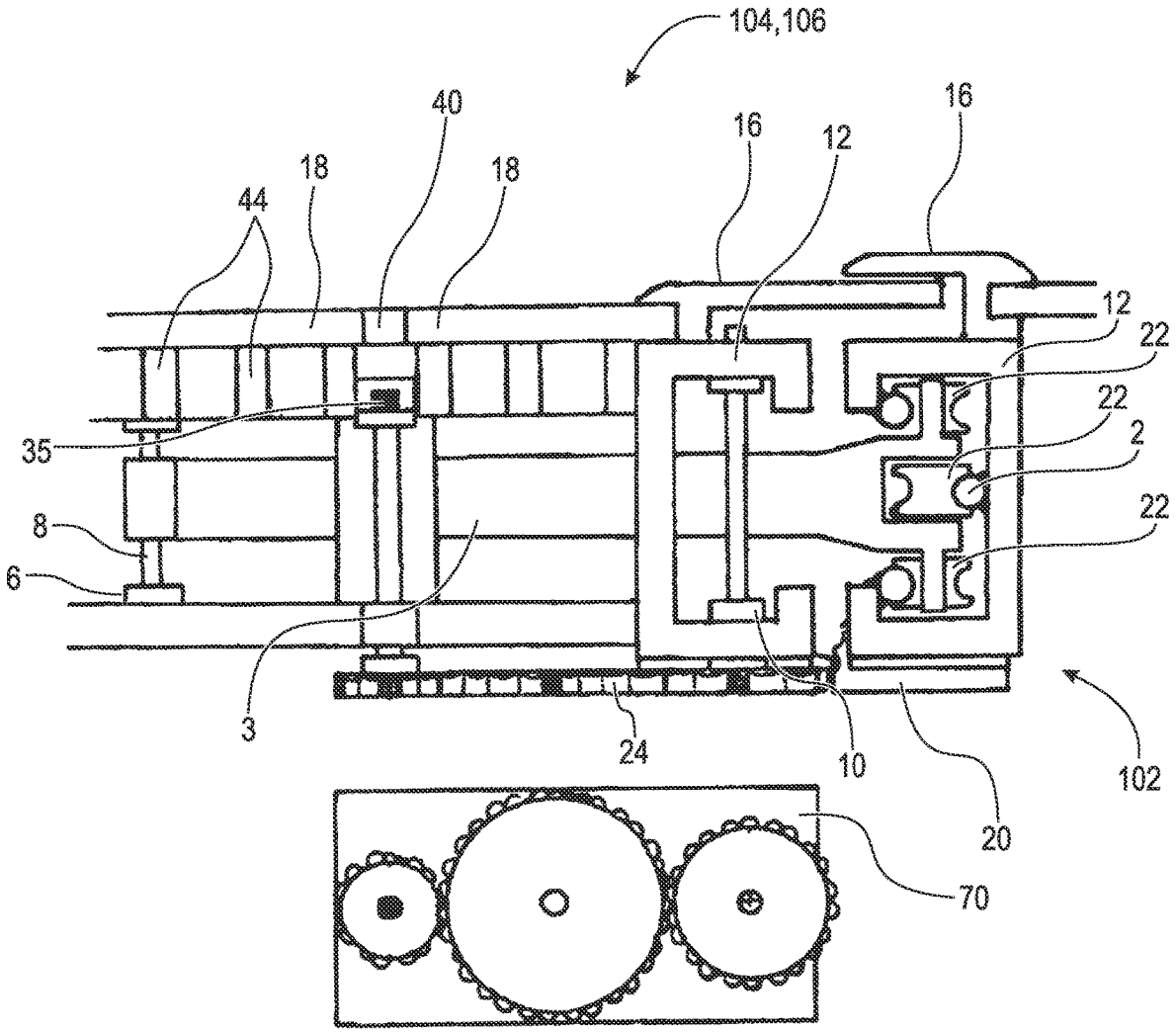
FIG. 14 is a side view of the overlapping top T-caps of the stationary dock section and one of the floating dock sections; and, FIG. 15 depicts components included in some or all of the accessories and the segmented C-Channel embodiment.

FIG. 13 is a top perspective view of the Top Hold Handle used to maneuver the dock sections 104 and 106, Rotation Handle 30*a*, Rotation Tool 30) with a Square Drive Female End 30*b* that interlocks with one of several Square Male Head Pins 35. FIG. 14 is a magnified view of the Gear Box 70, Gears 70*a-c*, Pivot Pin 8, C-channel 12, Interlocking Gear Teeth 20, Sealed Bearing 6, Pivot Swing Arm 3, Cam Rollers 22, Top T-Cap 16, Deck Boards 18, and Upper Support Brace 44.

Figure 15:
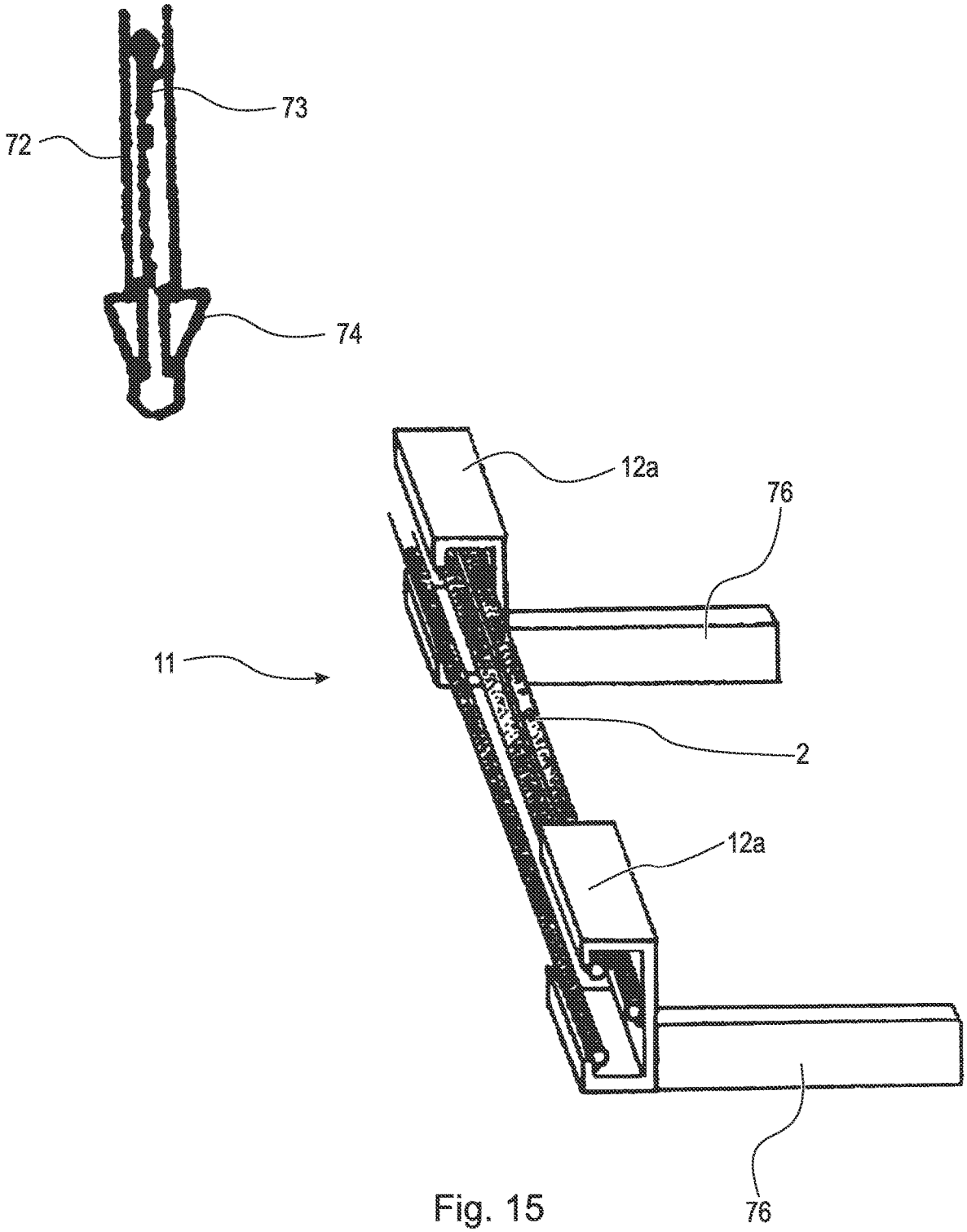

FIG. 15 depicts components included in some or all accessories will include Legs 72, Flip-up Lever 37, and Spring-loaded Locks 74, Segmented Tubular Track Section 11, Segmented C-channel 12, Tubular Track System 2, and Lower Support Brace 76.

The Transforming Floating Dock System 100 stationary section 102 works together with floating dock sections 104 and 106 (FIGS. 1-4). In a preferred embodiment, stationary dock 102 is approximately twice as long as floating docks 104 and 106, although persons of skill in the art will recognize that floating docks 104 and 106 may have varying lengths and widths. Both ends of the stationary dock section 102 have a round radius R that match identically to the radii R of all the other dock sections which keeps everything symmetrical. This design allows sections 104 and 106 to mechanically rotate with cam rollers 22, track tubing 2, and pivot points from the center of the radii R linked by evenly distanced pivot swing arms 3 and pivot cam roller braces 14. The rotation is driven by a rotation tool 30 that sleeves a square head pin 35 seen in FIG. 13 that has a gear 24 on the bottom of the pin 8 that may also have two sealed bearings 6 as seen in FIG. 5. The tool 30 inserts into the rotation hole 40 through various insertion points 42 (see FIGS. 5, 13, and 14) and meets with a long row of teeth 20 mounted on the bottom of all floating dock sections 104 and 106. The gear 24 and the integrated gear teeth 20 ("gear teeth 20") align so when the tool 30 is rotated this in turn rotates the floating dock sections 104 and 106 individually pivoting around the symmetrical radii R. Floating dock sections 104 and 106 can also be rotated by inserting rotation tool 30 through an insertion point 42 into gear 24 located next to center gear 21.

Everything that rotates and moves is completely symmetrical in shape size and length. System 100 includes built in stops in certain locations on the dock frame to stop the cam rollers 22 from over rotating. This feature will also aid in keeping the dock sections 104 and 106 tight and secure. The bullet holes 42 on the top portions of the system 100 are also symmetrical and placed in specific locations for locking sections 104 and 106 into place with tethered locking pins 10. The stationary dock 102 T-cap 16 will overlap all the other floating sections 104 and 106 T-caps 16 and the bullet holes 42 will line up for the insertion of the locking pins 10.

Another use for the bullet holes 42 is for the multiple accessory options (see FIGS. 8-12). Each optional accessory will be equipped with legs that lock it into position on the dock. There will be a flip up lever 37 which pushes down a release pin to retract the spring-loaded locks 74 as seen in FIG. 15 The top deck corner caps 45 will be removable so the composite deck planks 18 can simply slide into position on the T-caps 16. Therefore, there is no additional hardware needed to keep the deck boards 18 in place.

The corner caps 45 may need to be removed when rotating the dock sections into a new configuration. An alternative option will still have the gear 24 and pin 8 with sealed bearings 6 in the same location, but it will incorporate a sealed gear box 70 with 2-6 gears 24 located under the pivot roller cam swing arms 3. This will bring the location of the rotation tool 30 away from the top deck T-cap 16 so it will allow the non-stationary docks 104 and 106 to not hit the top corner caps during rotation (FIG. 14).

In an alternative embodiment, motors can be used to rotate the floating dock sections. Motors are located in dock sections 104 and 106. They are mounted next to and functionally attached to the manual gears 24 and brackets that are already in place so they would be very simple to add during initial construction of system 100 or in the future. By functional attachment is meant that the link between motors and gears 24, allows one of the components to function. For example, the functional attachment between the motors and gears 24. allows gears 24 to rotate dock sections 104 and 106 when the functionally attached motor is turned on. The motors operate by a remote or wired-in switch and include a signal wire to turn the power off to the motor to stop it at the desired dock position. In a further embodiment, a proportional control operates the motor at lower rpms when it starts to get close to the desired position. These motors are equipped with both pressure sensors and cam sensors for built-in safety features in case something gets lodged into the rotation system. Preferably, all wires and switches are waterproof. If the motors can't be waterproofed, they may be mounted in waterproof boxes.

Construction and Mechanics: (See FIGS. 5, 6, 7, 13, 14, and 15) The track system 2 used for the dock section rotations is located between the top decking planks 18 and the traditional floats (not shown) under the dock frame 12. The tubular track system 2 is built into the frame 12 of all dock sections. Floating dock section 102 is the main section and remains stationary with the exception of sliding up and down the pilings 108 with water rise and fall. A standard gangway will be used to gain access to the floating dock from shore. The materials used in the construction of the system 100 will consist of: composite decking planks 18, the dock frame construction 12, corner caps 45, pivot swing arms 3, tubular track systems 2, pivot cam roller braces 14, top T-caps 16, cam rollers 22, cam roller axles 22*a*, pivot pins 8, locking pins 10, sealed bearings 6, C-channels 12, gears 24, interlocking gear teeth 20, upper support braces 44 and lower support braces 76, pivot cam roller braces 14, cam roller stops 15, piling brackets 108*a*, top hold handle, rotation handle 30*a*, rotation tool 30, gear boxes 70, and all accessories with the exception of the attached mesh lounger 46 will be preferably available in either Marine Grade Aluminum, Aircraft Aluminum Grade 6061-T6 or 6063-T6, or Marine Grade Stainless Steel Grade 316L The use of these materials means no rust, no corrosion, no painting, staining or replacing deck boards; a very low maintenance system. FIGS. 5, 13, 14, and 15 illustrates the 3 roller C-channel system whereas FIG. 7 exhibits the optional 4 roller system. All of the floating dock sections ride on cams that roll on and around the tubular tracks 2 that are put into the frame 12. There can also be an access panel built into the frame system, a bolt in link of the frame, to easily install or remove the cam rollers as an assembly. The third possible design frame track system will be constructed the same as FIGS. 5, 13, 14 except it will have segmented C-channels with tube frame construction (FIG. 15). This will allow for less final product weight and material to help keep it more cost effective without effecting the integrity of quality or strength of system 100.

System 100 accommodates many more needs than a standard dock in that it can change a water floor plan with a simple crank of a handle or the push of a button. Thus, it is seen that the objects of the invention are efficiently obtained, although changes and modifications to the invention should be readily apparent to those having ordinary skill in the art, which changes would not depart from the spirit and scope of the invention as claimed.

PARTS LIST

2 tubular track system
3 Pivot Swing Arms
6 Sealed Bearings
8 pivot pin
10 locking pin
11 Segmented Tubular Track Section
12 C-channel frame
12*a* Segmented C-channel frame
14 Pivot Cam Roller Braces
15 Cam Roller Stop
16 top T-cap
18 Deck Planking
20 interlocking gear teeth
21 center gear
22 Cam Roller
22*a* Cam Roller Axle
24 Gear
30 Rotation Tool
30*a* Rotation Tool Handle
30*b* Square Drive Female End
35 Head Pin
37 Flip up Lever
40 Rotation Hole
42 Bullet Holes
44 Upper Support Brace
45 Corner Caps
46 Mesh Lounger
48 Floats
50 Lounger Clasps
52 Accessory Upper Support Brace
54 Railing Accessory
55 Dock float Accessory system
56 Ladder
58 Angled Rod Holder
60 Straight Rod Holder
62 Bench
64 Kayak Platform
66 Boat Bumper Rail
66*a* Boat Bumper Rail Insertion Pins
68 Cleat
70 Gear Box

72 Accessory Legs
73 Flip-up Lever
74 Spring-Loaded Locks
76 Lower Support Brace
100 Transformable Floating Dock System
102 Stationary Dock A
104 Movable Dock Sections B1, B2
106 Movable Dock Sections C1, C2
108 Pilings
R Radius

The invention claimed is:

1. A transformable multi-sectional floating dock system comprising:

a stationary dock section having a first end and a second end wherein said first end includes a first stationary round radius and said second end includes a second stationary round radius;

a first pair of floating dock sections, each one of said first pair of floating dock sections including a round radius and a rotation system; wherein each one of said first pair of rotating dock sections are functionally attached to each other at said round radii and one of said first pair of floating dock sections is operatively attached to said first stationary round radius;

a second pair of floating dock sections, each one of said second pair of floating dock sections including a round radius and a rotation system; wherein each one of said second pair of rotating dock sections are functionally attached to each other at said round radii and one of said second pair of floating dock sections is operatively attached to said second stationary round radius;

wherein each rotation system includes gears, cam rollers, tracks, tubing, and pivot points from the center of the radii linked by evenly distanced pivot swing arms and pivot cam roller braces;

wherein said rotation system of the first one of said first pair of rotating dock sections rotates said first one of said first pair of rotating dock sections around the second one of said first pair of floating dock sections and wherein said rotation system of said second one of said first pair of floating dock sections rotates said second one of said first pair of floating dock sections around said first end of said stationary dock system; and, wherein said rotation system of said first one of said second pair of rotating dock sections rotates said first one of said second pair of rotating dock sections around the second one of said second pair of floating dock sections and wherein said rotation system of said second one of said second floating dock system rotates said second one of said second pair of floating dock section around said second end of said stationary dock system.

2. The transformable multi-sectional floating dock system of claim 1 further comprising a rotation tool to operate each of said rotation systems.

3. The transformable multi-sectional floating dock system of claim 1 further comprising at least one motor functionally attached to at least one of said rotation systems.

4. The transformable multi-sectional floating dock system of claim 3 wherein one or more of said at least one motors is operated using a remote switch.

5. The transformable multi-sectional floating dock system of claim 3 wherein one or more of said at least one motors is operated using a wired-in switch.

6. The transformable multi-sectional floating dock system of claim 3 further comprising a proportional control wherein said proportional control operates said at least one of said at least one motor at lower rpms.

7. The transformable multi-sectional floating dock system of claim 1 wherein said floating dock system includes composite decking and wherein said rotation systems and each of said round radii of said floating dock sections and said round radii of said stationary dock section are constructed from at least one of the group of rust resistant materials consisting of Marine Grade Aluminum, Aircraft Aluminum Grade 6061-T6, Aircraft Aluminum Grade 6063-T6, Marine Grade Stainless Steel Grade 316L.

8. The transformable multi-sectional floating dock system of claim 1 further comprising one or more of the group of recreational items consisting of mesh lounger, gas grill, charcoal grill, boat bumper rails, bench seat, chair, umbrella, ladder, kayak platform, railings, tie-off cleat, and fishing rod holders.

* * * * *